US005385789A

United States Patent [19]

Rangaswamy et al.

[11] Patent Number: 5,385,789

[45] Date of Patent: Jan. 31, 1995

[54] COMPOSITE POWDERS FOR THERMAL SPRAY COATING

[75] Inventors: Subramaniam Rangaswamy, Rochester Hills; Robert A. Miller, Oak Park, both of Mich.

[73] Assignee: Sulzer Plasma Technik, Inc., Troy, Mich.

[21] Appl. No.: 121,824

[22] Filed: Sep. 15, 1993

[51] Int. Cl.[6] ..... B22F 7/02

[52] U.S. Cl. ..... 428/570; 75/255

[58] Field of Search ..... 428/551, 552, 565, 570; 75/255

[56] References Cited

U.S. PATENT DOCUMENTS

| | | | |
|---|---|---|---|
| 3,322,515 | 5/1967 | Dittrich et al. | 428/570 |
| 3,436,248 | 4/1969 | Dittrich et al. | 427/456 |
| 3,841,901 | 10/1974 | Novinski et al. | 106/1.05 |
| 4,019,875 | 4/1977 | Dittrich et al. | 428/570 |
| 4,181,525 | 1/1980 | Novinski | 75/255 |
| 4,313,760 | 2/1982 | Dardi et al. | 75/255 |
| 4,370,367 | 1/1983 | Novinski et al. | 75/255 |
| 4,578,115 | 3/1986 | Harrington et al. | 75/255 |
| 4,975,333 | 12/1990 | Johnson et al. | 428/570 |

*Primary Examiner*—George Wyszomierski
*Attorney, Agent, or Firm*—Dykema Gossett

[57] ABSTRACT

Composite thermal spray powders having a core to which fine particles of exothermically reacting aluminum or aluminum alloy and iron or copper fine particles are bonded. The thermal spray powders are useful in producing coatings having both high adhesive bond strength and good machinability.

12 Claims, 1 Drawing Sheet

COMPOSITE POWDERS FOR THERMAL SPRAY COATING

TECHNICAL FIELD

The present invention relates generally to thermal spray powders and more specifically to low-cost composite thermal spray powders which are used to form coatings having high adhesive bond strength and good machineability.

BACKGROUND OF THE INVENTION

In order to improve the surface properties of metal parts the parts may be coated utilizing thermal spray processes. Thermal spraying involves the use of a thermal spray gun through which a powdered material, typically metal, is propelled at high velocities. As it passes through the spray gun, the powder is heated by combustion gases (flame spraying) or an electric discharge (plasma spraying). The accelerated, high-temperature particles impact the metal target to form a coating which adheres to the target surface. In this manner, the surface properties of a metal part can be significantly altered to suit a particular application.

Through the years, a number of thermal spray powders have been developed. One such class of powders is characterized by composite particles of two or more metals or metal alloys bonded together with or without a binder material. It is also known that these composite powders may consist of a core metal with fine particles of another metal being bonded to the core surface.

For example, in U.S. Pat. No. 4,181,525, a thermal spray powder is described which has particles having a core of nickel, iron, copper, cobalt or alloys thereof coated with a binder. The binder contains discrete particles of aluminum and substantially pure nickel. The core material constitutes from 70–98% of the total mean content of the powder. The core particles range in size between −60 mesh and +3 microns. In addition to aluminum, it is disclosed therein that the binder may further include molybdenum. It has been discovered that although the fine nickel and aluminum help make the coating adherent, machineability is limited by the formation of hard nickel aluminide phases in the coating.

In U.S. Pat. No. 4,578,115, entitled, "Aluminum and Cobalt Coated Thermal Spray Powder," a thermal spray composite is disclosed having a base constituent formed of nickel, iron or cobalt and at east one of the modifying elements, chromium and aluminum, plus, as individual constituents, aluminum, cobalt and, optionally, molybdenum. Each particle comprises an alloy core of the base material and the modifying element, the core having fine particles of the individual elements secured to the core with a binder.

In addition, the manufacture of binderless clad particles by mechanical agglomeration is also known. For example in U.S. Pat. No. 4,915,987, to Nara, et al., a mechanical agglomeration technique is utilized to prepare particles consisting of a core of one material having a cladding of another material. In U.S. Pat. No. 4,818,567 to Kemp, metallic coated particles are disclosed which are formed by preparing a metal flake which is then mechanically applied to the surface of a core particle.

Powders have also been disclosed in which the components react exothermically during spraying. U.S. Pat. No. 3,436,248 entitled "Flame Spraying Exothermically Reacting Intermetallic Compound Forming Composites" describes methods of coating surfaces by flame spraying two or more components which react with one another during flame spraying to form an intermetallic compound. It is stated therein that each particle of the flame spray powder may consist of an aggregate containing the two components which exothermically react, but that preferably the individual particles are in the form of a clad composite consisting of a core of one of the components and at least one coating layer of the other component. It is also disclosed therein that the composite may consist of separate concentric coating layers of the two components and a nucleus of a third material. The methods disclosed for fabricating these prior art powders include chemical plating, vapor deposition, and by dispersing one component in a liquid binder which is then used to coat the core particle. It is stated that the component which is mixed with the binder is finely divided, as for example −325 mesh. It is also disclosed therein that the aggregates may be formed by compacting or briquetting the various components into the individual particles or into larger aggregates and then breaking these aggregates into the granules. The overall particle size is disclosed as between −60 mesh and +3 microns.

Despite the teachings of the prior art, it is clear that a need exists in the industry for a low-cost composite thermal spray powder which is highly adherent and yet which provides excellent machineability. The present invention provides a composite powder which meets these needs.

SUMMARY OF THE INVENTION

In one aspect, the present invention provides a thermal spray powder which is specifically designed to form a coating that bonds strongly to metal substrates (in many cases without the need for extensive surface preparation) and which is both wear-resistant and readily machinable. The individual particles which make up the powder are composite structures formed by agglomeration techniques. The particles have a core region and a surface region. The core is selected from one or more of the following metals: Ni, Fe, Go, Cu, and Cr. The core may also contain up to about 15% by weight of additional alloying metals such as Al, Y, Hf and the Lanthanides. The surface region is made up of finely divided particles that are either bonded to the core by a binder or are partially embedded in the core surface. At least two separate types of fine particles are bonded to the core to form the composite particle surface. The first type (first particulate material) is aluminum or an aluminum alloy. A number of other metals, such as silicon, magnesium, and titanium may be combined with the aluminum where an aluminum alloy is used, but aluminum should constitute at least 80% by weight of the first particulate material. In general, pure aluminum is preferred to any alloy. Preferred aluminum alloys are aluminum/silicon and aluminum/copper. The second type of fine particle (second particulate material) is selected from the group consisting of Fe and Cu, alloys of these metals with other metals (where Fe and/or Cu make up at least 80% by weight of the second particulate material) for example, Fe/Ni and Cu/Ni and oxides, hydroxides, carbonates, and/or nitrates of Fe and/or Cu.

In another aspect, the present invention provides a method of making the novel powders of the present invention. The method includes combining the components to form the desired aggregates. In a most preferred embodiment, this method includes the mechanical agglomeration of the first and second fine particulate materials onto the surface of the core particles through the use of limited-duration attrition milling as described in U.S. patent application Ser. No, 07/847,554, filed Mar. 6, 1992, the disclosure of which is incorporated herein by reference.

In still another aspect the present invention provides a method of forming a coating by thermal spraying the novel composite powders of the present invention on a target.

DETAILED DESCRIPTION OF THE PREFERRED EMBODIMENTS

Figure 1:
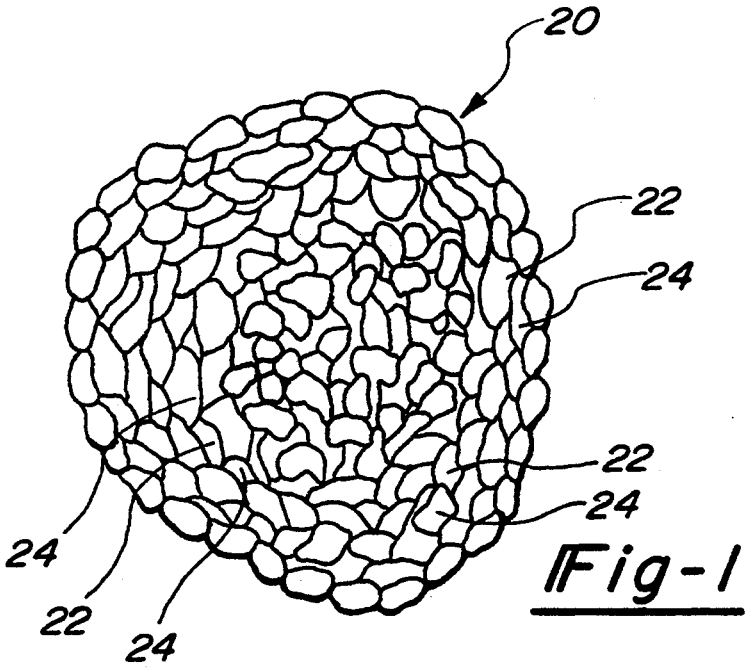
FIG. 1 is an elevational view of a composite particle made in accordance with the present invention.

As set forth in the foregoing summary, the present invention relates to an improved composite flame spray powder which produces a highly-adherent metal coating that exhibits superior machinability characteristics. In the broadest sense, the thermal spray powders of the invention comprise a core material to which much smaller particles, referred to herein as fine particulate material, are bonded. The selection of materials, their relative amounts, and their distribution all combine to form a particle and thus a powder which can be sprayed using conventional thermal spray devices and parameters such that an exothermic reaction is initiated in flight. This exothermic reaction produces additional particle heat and results in a combination of metals which produces the novel coating of the present invention.

PARTICLE CORE

The core or base material of the particles is most preferably selected from the group consisting of nickel, iron, cobalt, copper and chromium. Alloys of these materials may also be suitable. For example, the core material may comprise an alloy of nickel and copper or nickel, chromium and iron. Minor amounts of other metals which do not alter the basic metallurgical properties of the final coating may be tolerated in most instances in the core.

The core material comprises from about 70 to about 96 percent by weight of the individual particle, more preferably from about 80 to about 95 percent by weight, and most preferably from about 83 to about 93 percent by weight of the particle. Thus, the core material most preferably comprises from about 83 to about 93 percent of the novel thermal spray powder of the present invention.

The core material is initially provided as a coarse particle to which the additional components are preferably bound, The core particles range in size from about 38 to about 125 microns in diameter, more preferably from about 45 to about 106 microns and most preferably from about 45 to about 90 microns in diameter, In terms of the final powder the average core size is most preferably from about 60 to about 90 percent, In terms of mesh size the core particles which are used to produce the composite particles of the present invention are about −80/+635 and preferably −140/+400 U.S. standard mesh size. No significant change in the size of the core particles occurs during agglomeration with the fine particulate materials and thus these core size data also accurately describe the core in the final powder.

FINE PARTICULATE MATERIAL

As stated, the novel composite particles of the present invention further include a plurality of discrete regions of two dissimilar materials which interact to produce an exothermic reaction during thermal spraying. While it may be possible to provide these materials as internal inclusions or regions within the particle slightly below the core surface, in the most preferred embodiment of the present invention the fine particulate materials comprise substantially distinct particles bonded to the core surface. This may be achieved by a number of techniques such as spray drying and the like. In one embodiment, the fine particulate materials are added to a liquid binder which is then used to coat the core particles. Numerous suitable binders will be known to those of skill in the art such as phenolic binders. PVP (polyvinylpyrrolidone) is a particularly preferred binder. Where a binder is used in the present invention, the binder should constitute no more than about 5 percent by weight of the particle, more preferably less than about 3 percent by weight of the particle, and most preferably a fugitive binder is utilized.

In a more preferred embodiment, the particles of the present invention are produced by mechanical agglomeration using the attritor agglomeration described in co-pending U.S. application Ser. No. 07/847,554, filed Mar. 6, 1992, assigned to the assignee of the present application and the disclosure of which is incorporated herein by reference. Particles produced by this method have the fine particulate materials embedded slightly in the surface of the core particles; on average from about 1 to about 10 percent by volume of each fine particle is embedded in the core. Of course, there must be sufficient bonding between the fine particulate materials and the core particles such that the composite particles remain intact in storage and during spraying.

At least two separate types of fine particulate materials are bonded to the core to form the particle surface. The first particulate material is aluminum or an aluminum alloy. A number of other metals, such as silicon, magnesium, and titanium may be combined with the aluminum where an aluminum alloy is used, but aluminum should constitute at least 80 percent by weight of the first particulate material. In general, pure aluminum is preferred to any alloys. Preferred aluminum alloys are aluminum/silicon and aluminum/copper. The second type of fine particulate material is selected from the group consisting of Fe, Cu, alloys of these metals with other metals, for example, Fe/Ni and Cu/Ni, (where Fe and/or Cu make up at least 80 percent by weight of the second particulate material) and oxides, hydroxides, carbonates, and/or nitrates of Fe and/or Cu.

Figure 2:
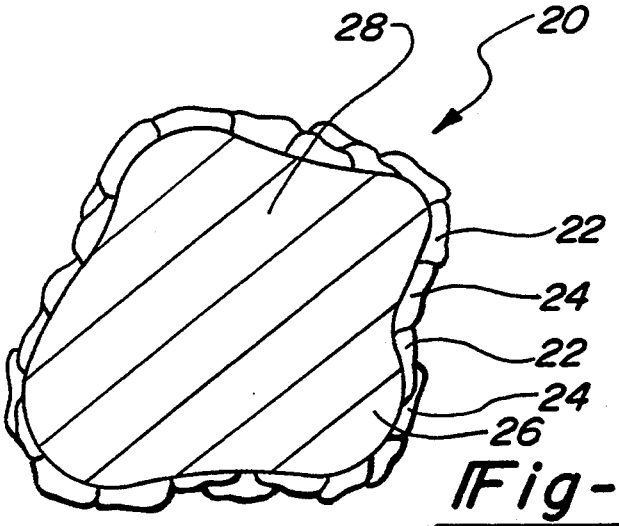
FIG. 2 is a cross-sectional view of a composite particle made in accordance with the present invention.

Thus, it will be understood that the plurality of fine particulate dissimilar materials comprise at least two dissimilar materials provided as discrete particles. Referring now to FIGS. 1 and 2 of the drawings, composite core particle 20 is shown on which a plurality of fine particulate materials 22 and 24 (not to scale) are shown partially bonded to or embedded in surface region 26 of core 28. In this illustration, fine particles 22 are aluminum and fine particles 24 are iron. The first and second particles are in intimate contact such that they undergo an exothermic reaction during thermal spraying.

The aluminum or aluminum alloy fine particulate material comprises from about 3 to about 20 percent by weight of the individual composite particle, more preferably from about 4 to about 15 percent by weight, and most preferably from about 5 to about 12 percent by weight of the composite particle. Thus, the first fine particulate material most preferably comprises from about 5 to about 12 percent by weight of the finished thermal spray powders of the present invention.

The second fine particulate material comprises from about 0.5 to about 10 percent by weight of the individual composite particle, more preferably from about 1 to about 7, and most preferably from about 1.5 to about 4 percent by weight. Thus, the second fine particulate material comprises from about 1.5 to about 4 percent by weight of the final powder.

The particles of the fine particulate materials range in size from about 0.2 to about 10 microns in diameter, more preferably from about 0.5 to about 5 microns and most preferably from about 1.0 to about 4 microns in diameter.

The thermal spray material of the present invention is most preferably provided in the form of a powder although compaction or the like into wires or rods may be possible in a particular application. Where provided as a powder, the present invention is preferably about −80/+635 U.S. mesh, more preferably about −140/+400 U.S. mesh and most preferably about −140/+325 U.S. mesh.

In accordance with the method of the present invention, the novel powders described herein are sprayed using conventional thermal spray apparatus to form highly-adherent, machinable coatings on metal substrates. The operating parameters of the thermal spray apparatus are conventional, but must provide sufficient heat to the powder to produce the desired exothermic reaction involving the dissimilar types of fine particulate materials of the powder. The dissimilar fine particles thus react with one another and interact with the core material and possibly the ambient atmosphere to produce superheated droplets which bond exceptionally well to many substrates. Some steels and other substrates may be coated adequately in this manner without the need for prior surface roughening. By elimination of any significant amount of nickel in the fine particulates, the resultant coating lacks the nickel aluminide phases which otherwise reduce the machineability of the coating. In order to more fully illustrate the present invention the following examples are provided which are not in any manner intended to limit the full scope of the invention as described in the appended claims.

| EXAMPLE | CORE | CLADDING | BINDER | RESULT |
|---|---|---|---|---|
| 1 | 60Fe—40Ni alloy (−140 + 325 mesh) | 2% Fe (2 μm) 5% Al (2 μm) | 2% PVP Binder | Excellent self bonding and machinability |
| 2 | 90Cu—10Al alloy (−120 + 325 mesh) | 2% Fe 2 (μm) 5% Al 2 (μm) | 2% PVP Binder | Excellent self bonding and machinability |

While the invention has been described in connection with specific embodiments thereof, it is evident that many alternatives, modifications, and variations will be apparent to those skilled in the art in light of the foregoing description. Accordingly, it is intended to embrace all such alternatives, modifications and variations that fall within the spirit and broad scope of the appended claims.

What is claimed is:

1. A thermal spray powder comprising a plurality of composite particles, the composite particles of said powder comprising:

a core portion of at least one metal selected from the group consisting of nickel, iron, cobalt, copper and chromium, and combinations and alloys thereof, said one metal comprising at least about 85 percent by weight of said core, and said core comprising between about 70 to 96 percent by weight of said composite particle;

at the surface of said core portion, a first plurality of particles of a first metal selected from the group of aluminum and its alloys, wherein aluminum comprises at least about 80 percent by weight of said first plurality of particles and wherein said first plurality of particles comprises between about 3 to 20 percent by weight of said composite particle;

at the surface of said core portion a second plurality of particles of a second metal selected from the group consisting of iron, copper, iron alloys, and copper alloys, wherein at least 80 percent by weight of said second plurality of particles comprises iron, copper or a combination of iron and copper, said second plurality of particles comprising between about 0.5 to 10 percent by weight of said composite particle, and wherein said first and second plurality of particles are capable of reacting exothermically during a thermal spray process.

2. The thermal spray powder recited in claim 1, wherein said first plurality of particles are aluminum and said second plurality of particles are iron.

3. The thermal spray powder recited in claim 1, wherein said second metal is present as a metal oxide.

4. The thermal spray powder recited in claim 1, wherein said second metal is present as a metal hydroxide.

5. The thermal spray powder recited in claim 1, wherein said second metal is present as a metal carbonate.

6. The thermal spray powder recited in claim 1, wherein said second metal is present as a metal nitrate.

7. The thermal spray powder recited in claim 1, wherein said core metal comprises an alloying metal selected from the group consisting of Al, Y, Hf and the Lanthanides.

8. The thermal spray powder recited in claim 1, wherein said first and second plurality of particles are fine particulate material bonded to said core.

9. The thermal spray powder recited in claim 8, further including a binder by which said fine particulate material is bonded to said core.

10. The thermal spray powder recited in claim 9, wherein said binder is polyvinylpyrrolidone.

11. The thermal spray powder recited in claim 8, wherein said fine particulate material has a size of about 0.2 to 10 microns.

12. A thermal spray powder comprising a plurality of composite particles, in which the individual composite particles comprise:

a core, at least about 85 percent by weight of which is formed of a metal selected from the group consisting of nickel, iron, cobalt, copper, and chromium, and combinations and alloys thereof;

a plurality of particles of a first particulate material bonded to said core, said first particulate material being selected from the group consisting of aluminum and aluminum alloys with aluminum forming at least 80 percent by weight of said first particulate material;

a plurality of particles of a second particulate material bonded to said core, said second particulate material being selected from the group consisting of iron, copper, and alloys thereof, with iron, copper or a combination of iron and copper forming at least about 80 percent by weight of said second particulate material, said core forming from about 70 to about 96 percent by weight of said composite particle;

said first particulate material forming from about 3 to about 20 percent by weight of said composite particle; and said second particulate material forming from about 0.5 to about 10 percent by weight of said composite particle.

* * * * *